US010847293B2

(12) United States Patent
Pandey et al.

(10) Patent No.: US 10,847,293 B2
(45) Date of Patent: Nov. 24, 2020

(54) MAGNETIC CORE WITH FLEXIBLE PACKAGING

(71) Applicant: CUMMINS INC., Columbus, IN (US)

(72) Inventors: Nikhil Pandey, Columbus, IN (US); Philip E. Becker, Columbus, IN (US); Miguel Angel Gonzalez, Jr., Columbus, IN (US); Anirban De, Columbus, IN (US)

(73) Assignee: Cummins Inc., Columbus, IN (US)

( * ) Notice: Subject to any disclaimer, the term of this patent is extended or adjusted under 35 U.S.C. 154(b) by 638 days.

(21) Appl. No.: 15/506,231

(22) PCT Filed: Oct. 22, 2015

(86) PCT No.: PCT/US2015/056903
§ 371 (c)(1),
(2) Date: Feb. 23, 2017

(87) PCT Pub. No.: WO2016/085598
PCT Pub. Date: Jun. 2, 2016

(65) Prior Publication Data

US 2018/0218816 A1 Aug. 2, 2018

Related U.S. Application Data

(60) Provisional application No. 62/084,168, filed on Nov. 25, 2014.

(51) Int. Cl.

| | |
|---|---|
| ***H01F 27/28*** | (2006.01) |
| ***H01F 3/04*** | (2006.01) |
| ***H01F 27/02*** | (2006.01) |
| ***H01F 3/14*** | (2006.01) |
| ***H01F 17/06*** | (2006.01) |
| ***H01F 41/02*** | (2006.01) |

(52) U.S. Cl.
CPC ..... *H01F 3/04* (2013.01); *H01F 3/14* (2013.01); *H01F 17/06* (2013.01); *H01F 17/062* (2013.01); *H01F 27/02* (2013.01); *H01F 41/022* (2013.01); *H01F 2017/065* (2013.01)

(58) Field of Classification Search
CPC ..... H05K 9/0066; H01F 2017/065
USPC ..... 336/175, 176
See application file for complete search history.

(56) References Cited

U.S. PATENT DOCUMENTS

| | | | | |
|---|---|---|---|---|
| 3,436,707 | A | 4/1969 | Derbyshire et al. | |
| 4,765,861 | A | 8/1988 | Curtis, Jr. et al. | |
| 5,449,126 | A | 9/1995 | Yee et al. | |
| 6,078,241 | A * | 6/2000 | Watanabe | H03H 1/0007 333/12 |
| 6,992,555 | B2 | 1/2006 | Hasegawa et al. | |
| 7,652,551 | B2 | 1/2010 | Buswell | |

(Continued)

OTHER PUBLICATIONS

English translation of JP 07263250 (Year: 1995).*
International Search Report and Written Opinion dated Jan. 14, 2016 in PCT/US2015/056903.

*Primary Examiner* — Ronald Hinson
(74) *Attorney, Agent, or Firm* — Faegre Drinker Biddle & Reath LLP

(57) ABSTRACT

The disclosure provides a core, comprising a body formed from a winding of tape shaped material, and a package encasing the body. A single gap is formed in the body and the package. A clamp is connected to the package to flex a flexible section of the package to reduce the gap.

18 Claims, 6 Drawing Sheets

(56) References Cited

U.S. PATENT DOCUMENTS

| | | | | |
|---|---|---|---|---|
| 7,859,379 | B2 * | 12/2010 | Uemura | H01F 3/14 336/174 |
| 8,138,877 | B2 | 3/2012 | Demolis et al. | |
| 2010/0156586 | A1 | 6/2010 | Hundt et al. | |
| 2012/0262266 | A1 | 10/2012 | Herzer et al. | |
| 2014/0253100 | A1 | 9/2014 | Lepine et al. | |

* cited by examiner

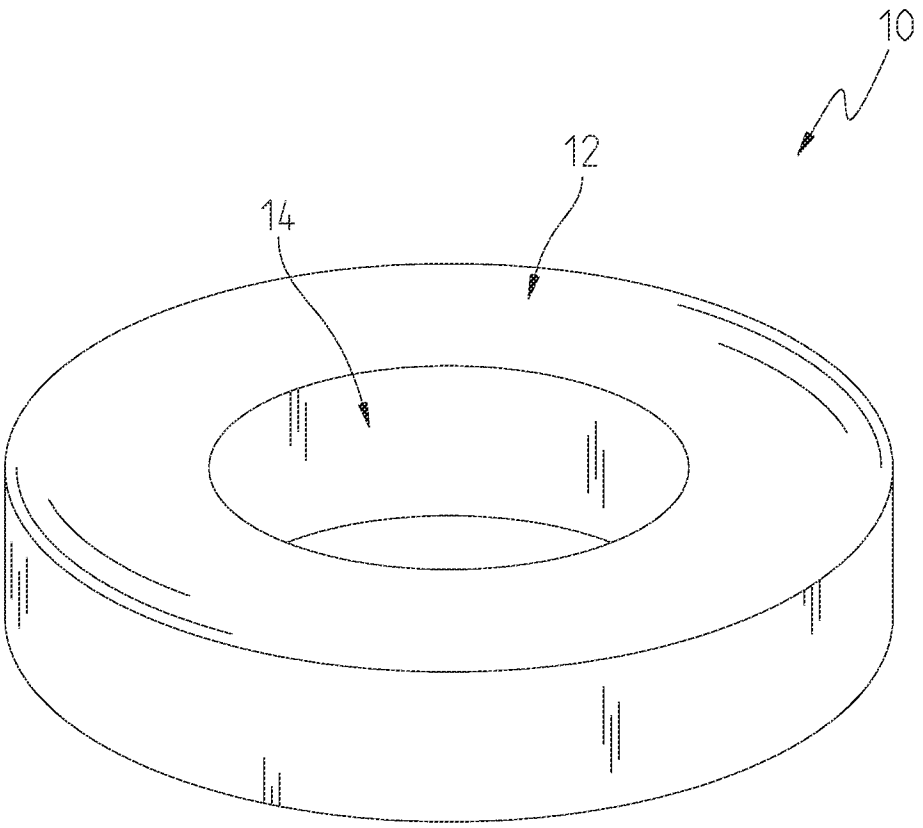
FIGURE 1 - Prior Art

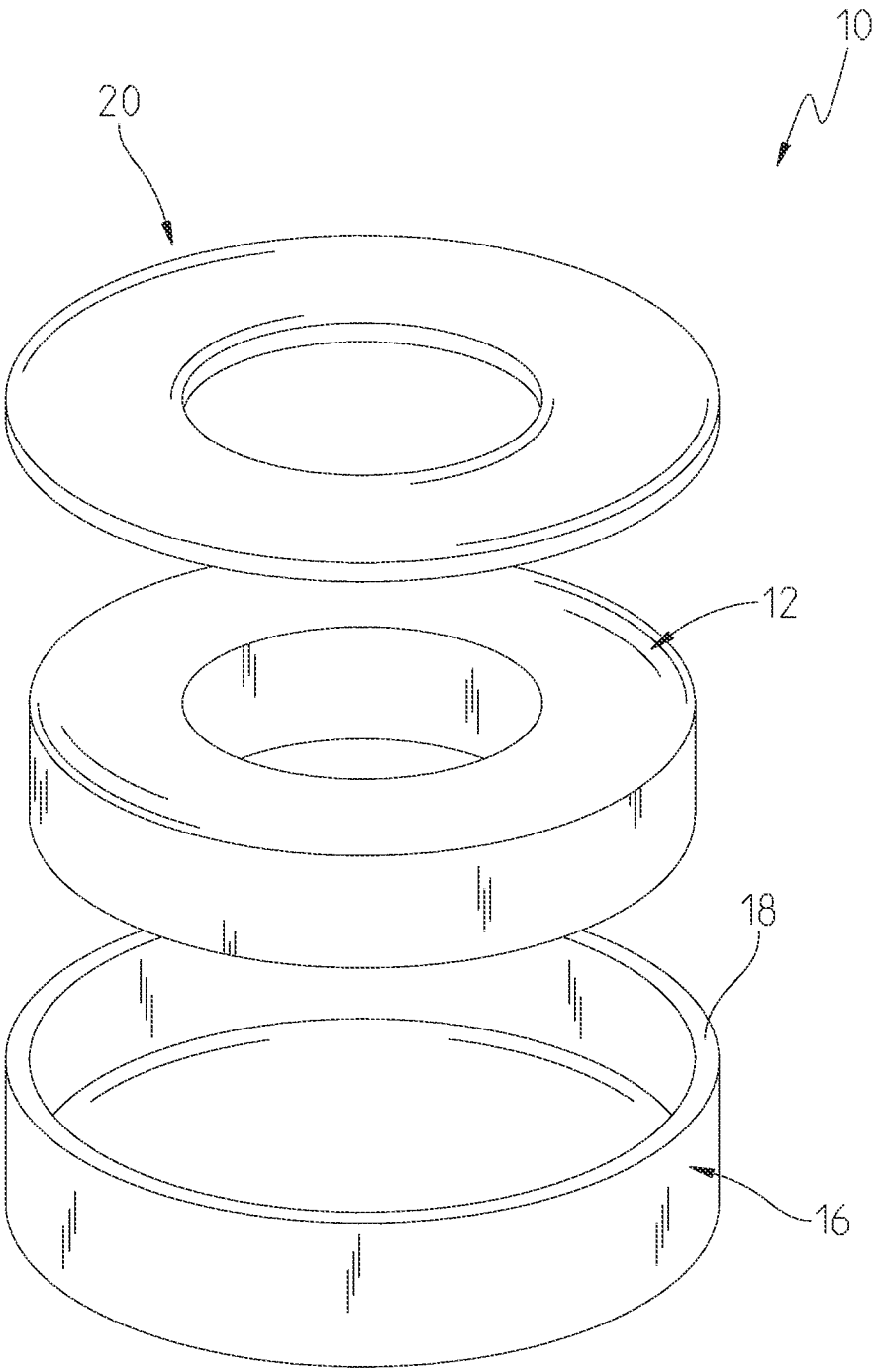
FIGURE 2 - Prior Art

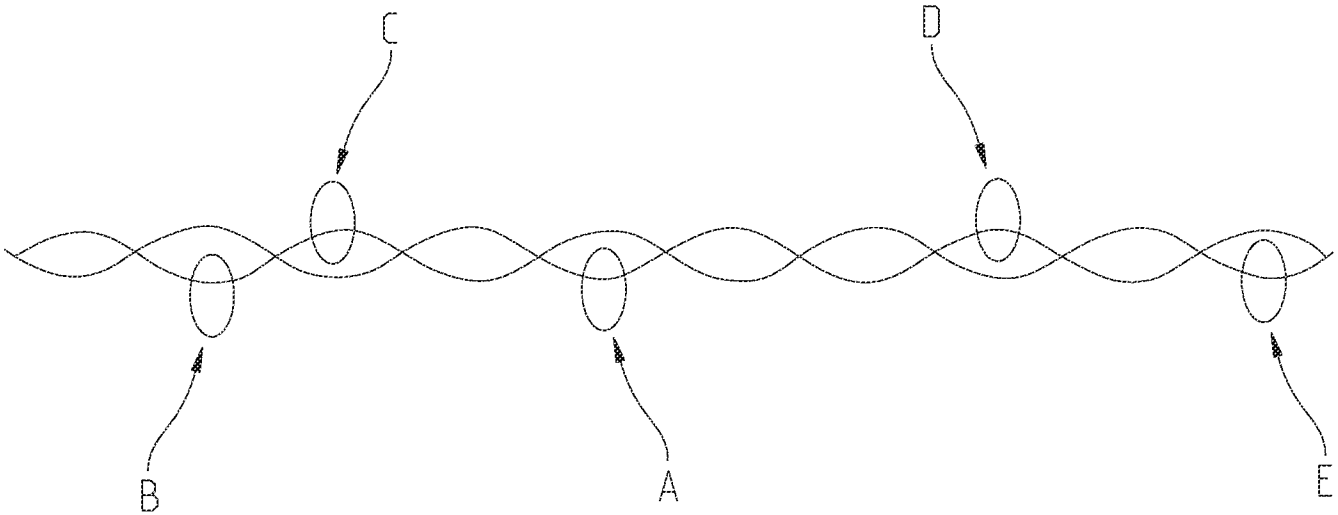
FIGURE 3 - Prior Art

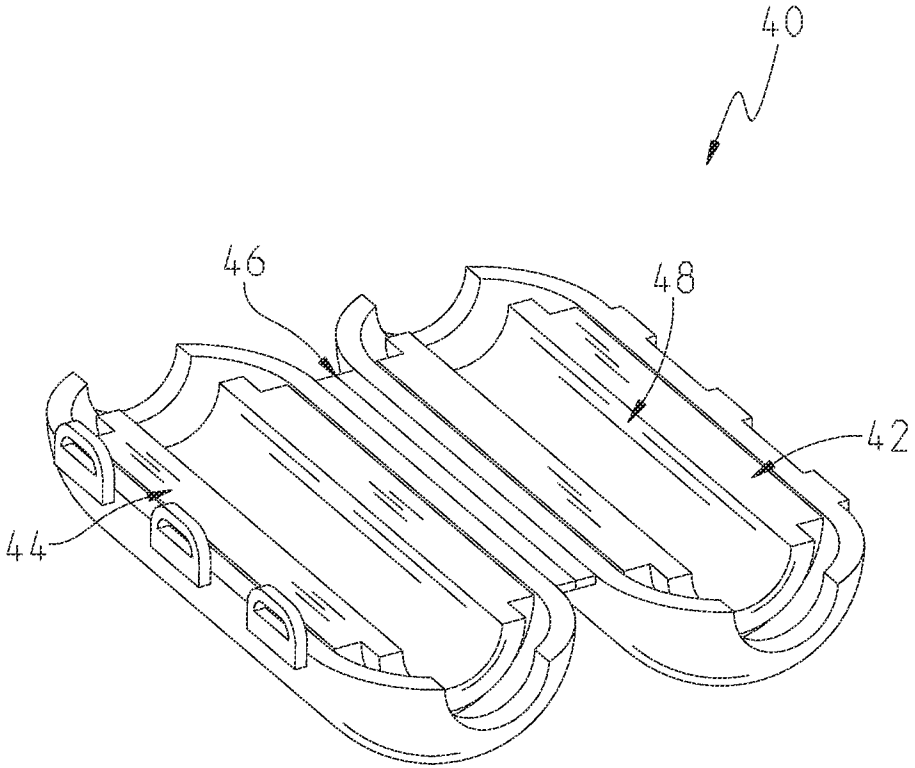
FIGURE 4 - Prior Art

MAGNETIC CORE WITH FLEXIBLE PACKAGING

CROSS-REFERENCE TO RELATED APPLICATION

The present application is a National Stage of International Application No. PCT/US2015/056903, filed Oct. 22, 2015, which claims priority to U.S. Provisional Application No. 62/084,168, filed Nov. 25, 2014, the entire disclosures of which are hereby expressly incorporated herein by reference.

TECHNICAL FIELD

The present disclosure relates generally to magnetic cores and more particularly to magnetic cores having a single gap and flexible packaging.

BACKGROUND OF THE DISCLOSURE

Magnetic cores are available in a variety of shapes and sizes. Generally, magnetic cores have magnetic material inside such as soft iron, laminated silicon steel, carbonyl iron, iron powder, ferrite and vitreous material. These cores may be formed into shapes such as air cores, straight cylindrical rods, tape wound cores, alphabet letter shaped cores (I, E, C, U, E-I, paired E, E-P, EFD, E-R, etc.), pot cores, toroid cores, rings or bead cores, and planar cores. Applications for such cores include, but are not limited to couplers and transformers.

FIGS. 1 and 2 show a prior art tape wound core 10. Core 10 may be a toroidal tape wound core such as the VITROPERM® products made available by VACUUMSCHMELZE GmbH & Co. KG. Core 10 includes a toroidal shaped body 12 made by winding a long, very thin strip of nanocrystalline material onto itself. Body 12, which is somewhat flexible, but brittle, includes a central opening 14 and is encased within a package 16 generally made of plastic or epoxy. The open end 18 of package 16 is sealed off using a cover 20.

When a core such as core 10 is used as a coupler, a wire or wires are passed through central opening 14 of the core. FIG. 3 shows an example application where multiple cores are used as couplers on a twisted wire pair. If one core fails in this application, then the entire twisted wire assembly must be disassembled to the extent necessary to remove and replace the failed core. For example, if core A fails, then the wires must be untwisted, cores B and C (or cores D and E) removed, core A removed and replaced, cores B and C (or cores D and E) replaced, and the wires re-twisted. This repair procedure is time consuming and therefore expensive. Essentially, in the prior art embodiments, all cores are attached to one harness, and removal of a core may include unplugging from the headers, removal of the P-clips from the engine, removal of the harness for servicing, removal of affected wires from the connectors, cutting of the braiding on the harness, untwisting of the wires to the point of failure and replacement of the core, re-twisting of the wiring, and re-securing of the harness on the engine and reattachment of the connectors at their respective locations.

One prior art approach to facilitating core replacement is depicted in FIG. 4. As shown, core 40 may be disassembled. Core 40 is cut into two core halves 42, 44 which are connected to one another by a hinge 46. A wire or wires may be passed through the central opening 48 of core 40. Then, halves 42, 44 may be closed onto one another over the wire and fastened together using fasteners or other means for retaining or joining halves 42, 44. If core 40 fails, then halves 42, 44 may be unfastened from one another, and core 40 may be removed. Another core of similar construction may be used to replace core 40 without disassembling other components of the assembly.

As should be apparent from FIG. 4, core 40 has two discontinuities or gaps: one at hinge 46 and one at the ends of halves 42, 44 opposite hinge 46. These gaps cause low permeability (also called magnetic permeability) of core 40 and increased core losses, which may be undesirable characteristics when compared to a solid core of the same size and shape depending upon the electromagnetic needs of the electrical application. Additionally, halves 42, 44 in this configuration may grind against one another and may never actually meet when closed onto one another. This also leads to undesirable performance characteristics.

SUMMARY OF THE DISCLOSURE

In one embodiment, the present disclosure provides a magnetic core, comprising a core body formed from a winding of material, a package that receives the core body, the package including at least a partially flexible portion, an outer surface, and an inner surface defining a central opening of the core, a gap formed though the core body and the package between the outer surface of the package and the inner surface of the package, and a clamp having a first position in which the clamp secures the core in a closed position wherein the gap is decreased and a second position in which the clamp permits the core to move to an opened position wherein the gap is increased to permit passage of a wire into the central opening. In one aspect of this embodiment, the core body is formed in the shape of a toroid. In another aspect, the material is a flexible magnetic material. In another aspect, the package is formed of at least one of rubber or plastic. Yet another aspect of this embodiment further comprises a sealing material disposed in the gap to protect the core body from environmental conditions. In another aspect, the core body has a first end defining one side of the gap, a second end defining another side of the gap, and a continuous section extending between the first end and the second end. Still another aspect further comprises, a movable member coupled to the package to permit passage of a wire through the gap and into the central opening and to inhibit passage of the wire out of the central opening. In a variant of this aspect, the movable member is a biased hinge having one end attached to the inner surface of the package on one side of the gap and a flexible body extending across the gap.

Another embodiment according to the present disclosure provides a core, comprising a body formed from a winding of tape shaped material, a package encasing the body, the package having an outer surface and an inner surface defining a central opening, the outer surface being radially outward of the outer surface of the body and the inner surface being radially inward of the inner surface of the body, the package including a flexible section, a single gap formed in the body and the package that extends between the outer surface of the package and the inner surface of the package through the body, and a clamp connected to the package, the clamp having a first end connected to the package on a first side of the gap and a second end connected to the package on a second side of the gap, the clamp being movable to a closed position thereby flexing the flexible section of the package such that the first side of the gap is moved toward the second side of the gap to reduce the gap. In one aspect of this embodiment, the clamp is movable to an opened position thereby permitting the flexible section of the package to return to an unflexed state such that the gap is increased to permit passage of a wire into the central opening. In another aspect, the body is formed of magnetic material wound into the shape of a toroid. In a variant of this aspect, the magnetic material is a flexible magnetic material. In another aspect, the package is formed of at least one of rubber or plastic. Yet another aspect further comprises a sealing material disposed in the gap to protect the body from environmental conditions. In another aspect, the body has a first end defining one side of the gap, a second end defining another side of the gap, and a continuous section extending between the first end and the second end. Still another aspect further comprises a movable member coupled to the package to permit passage of a wire through the gap and into the central opening and to inhibit passage of the wire out of the central opening.

Still another embodiment of the present disclosure provides a method of forming a magnetic core, comprising winding material into a core body, enclosing the body in a package having a partially flexible portion, an outer surface, and an inner surface defining a central opening of the core, forming a gap through the body and the package between the outer surface of the package and the inner surface of the package, and installing a sealing material in the gap to protect the body from environmental conditions. One aspect of this embodiment further comprises attaching a clamp to the package, the clamp having a first position in which the clamp secures the core in a closed position wherein the gap is decreased and a second position in which the clamp permits the core to move to an opened position wherein the gap is increased to permit passage of a wire into the central opening. Another aspect further comprises coupling a movable member to the package to permit passage of a wire through the gap and into the central opening and to inhibit passage of the wire out of the central opening. In a variant of this aspect, the movable member is a biased hinge having one end attached to the inner surface of the package on one side of the gap and a flexible body extending across the gap.

BRIEF DESCRIPTION OF THE DRAWINGS

Embodiments of the present disclosure will now be described, by way of example only, with reference to the accompanying drawings, in which:

FIG. 1 is a perspective view of a prior art tape wound core body;

FIG. 2 is an exploded, perspective view of a prior art tape wound core;

FIG. 3 is a conceptual view of a twisted pair wire application using the core depicted in FIG. 1;

FIG. 4 is a perspective view of another prior art tape wound core;

Figure 5A:
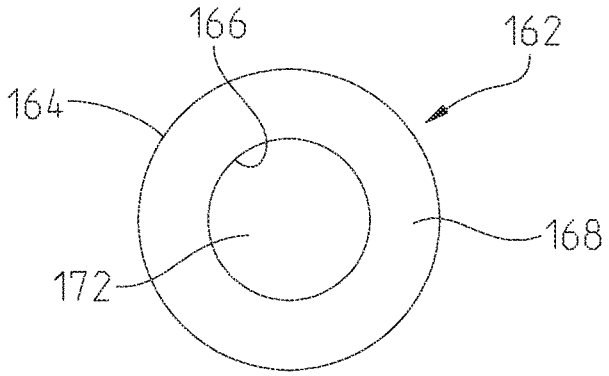
FIG. 5(A) is a top view of a package according to one embodiment of the present disclosure.
Figure 5B:
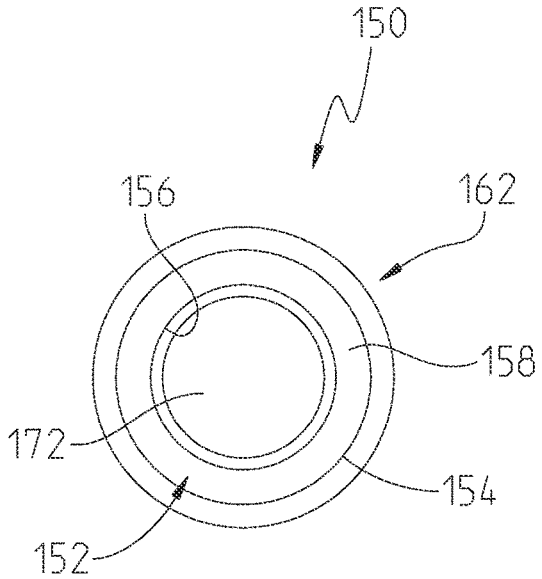
FIG. 5(B) is a top view of a core according to one embodiment of the present disclosure prior to formation of a gap in the core.

While the disclosure is amenable to various modifications and alternative forms, specific embodiments have been shown by way of example in the drawings and are described in detail below. The disclosure, however, is not to limit the invention to the particular embodiments described. On the contrary, the invention is intended to cover all modifications, equivalents, and alternatives falling within the scope of the invention as defined by the appended claims.

DETAILED DESCRIPTION OF EMBODIMENTS OF THE DISCLOSURE

FIGS. 5(A)-(D) depict a first embodiment of a core according to the principles of the present disclosure. Core 150 includes a body 152 (FIG. 5(B)), which may be formed in the shape of a toroid or cylinder, made by winding material, for example, of the type and in the manner described above with reference to FIGS. 1-3. In certain embodiments, the material is vitreous material or a flexible magnetic material. Body 152 includes an outer surface 154, an inner surface 156, a first side surface 158 and a second side surface 160 (not shown). Body 152 is encased within a package 162 (FIG. 5(A)), which may be formed of rubber, plastic or other suitable flexible material. Package 162 includes an outer surface 164, an inner surface 166, a first side surface 168 and a second side surface 170 (not shown). Inner surface 166 of package 162 defines a central opening 172 for receiving a wire or wires such as in the twisted pair application described above.

Figure 5C:
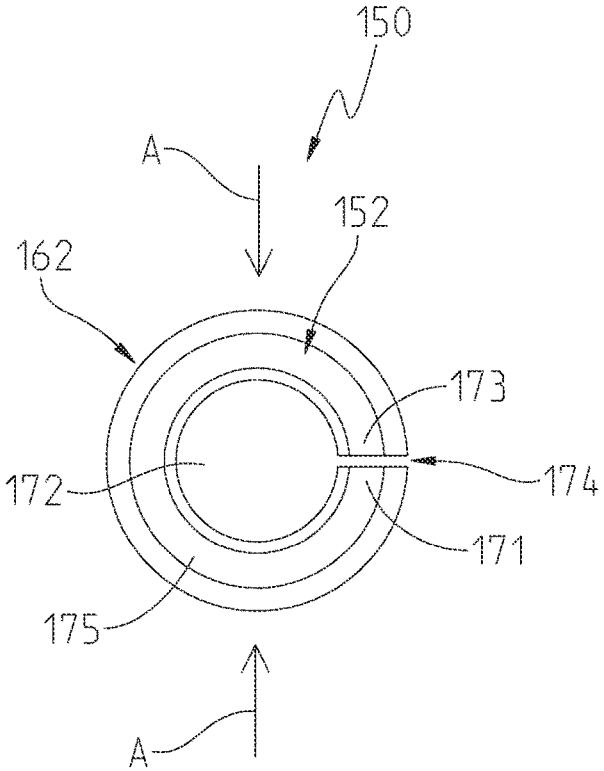
FIG. 5(C) is a top view of the core of FIG. 5(B) with a gap.

As shown in FIG. 5(C), in one embodiment after body 152 is installed in package 162, a narrow slit or gap 174 is formed through package 162 and body 152 between outer surface 164 of package 162 and inner surface 166. After gap 174 is formed, the free ends of body 152 and package 162 are sealed, for example, using epoxy or other sealing material to protect body 152 from environmental conditions and chemical conditions which often exist in automotive applications. Also, sealing the ends helps to protect against environment induced degradation of the material or its properties. Because body 152 and package 162 are flexible, exerting pressure in the direction of arrows A will cause gap 174 to close. Depending upon the size of core 150, the pressure to close gap 174 may be applied with one hand. Releasing such force permits core 150 to return to its uncompressed state such that gap 174 is again opened. It should also be understood that gap 174 may be expanded by applying pressure in a direction opposite arrows A from within central opening 172. This may be desirable to accommodate passage of a thick wire or bundle of wires through gap 174.

It should be understood that in a variation of this embodiment, gap 174 may be pre-formed in package 162. In this variation, only core body 152 is cut to form gap 174. After gap 174 is formed in body 152, body 152 is placed in package 162 such that body 152, including the free ends of body 152 formed upon creation of gap 174, is completely enclosed within package 162. In either variation of this embodiment, package 162 is constructed of material that permits deformation of body 152 (i.e., to close gap 174) but inhibits excessive deformation that may cause body 152 to break.

Figure 5D:
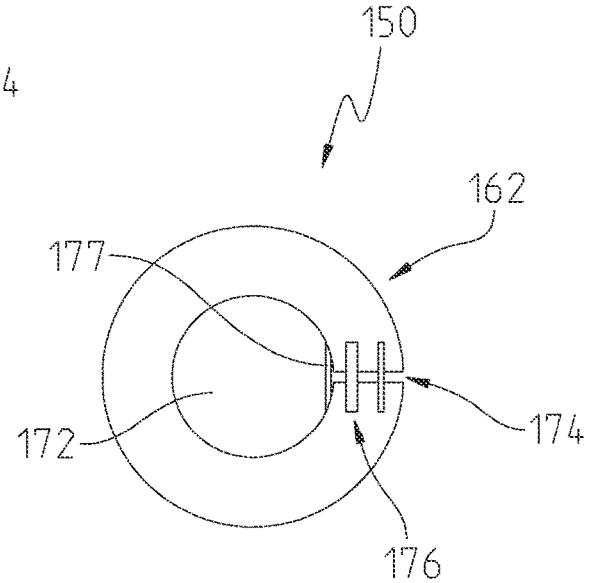
FIG. 5(D) is a top view of the core of FIG. 5(C) with a clamp.

As shown in FIG. 5(D), gap 174 may be retained in a closed position by using a clamp 176 or other suitable device. Clamp 176 may be constructed in a variety of ways with the function of closing gap 176, retaining it in a closed position and aligning the free ends of core 150. Thus, clamp 176 may be constructed as a spring latch, a slam latch, a cam lock, a Norfolk latch, a Suffolk latch, a crossbar, a cabin hook, or any other suitable clamping means. Clamp 176 may also include a movable member 177 which is constructed to permit a wire or wires to pass through gap 174 into central opening 172 but inhibit such wire or wires from passing the other direction out of opening 172. In this regard, movable member 177 be a biased hinge having one on one end attached to the inner surface of package 162 on one side of gap 174 and a flexible body extending across gap 174 that permits the other end of movable member 177 to pivot into opening 172 as a wire is passed into opening 172 and snap back to cover gap 174 after the wire has passed. Alternatively, movable member 177 may include one or more flexible elements that flex in one direction to permit passage of a wire and return to an un-flexed position (perhaps overlapping) to prevent movement of the wire in the opposite direction. Other suitable movable members 177 will be apparent to those skilled in the art.

It is desirable to maintain gap 174 in the closed position during operation of core 150 to obtain the desired performance characteristics from core 150. As the configuration of core 150 permits gap 174 to be opened and closed, when core 150 fails in a twisted pair application such as that described above with reference to FIG. 3, clamp 176 may simply be removed to permit gap 174 to move to the opened position, and core 150 may be removed from the wire or wires that extend through central opening 172. The wire or wires may then be passed through gap 174 of a new core 150 into central opening 172, and gap 174 of the new core 150 may be closed using clamp 176. In this manner, none of the other components of the application need to be disturbed in the process of replacing core 150.

As will be understood by one of skill in the art, gap 174 is defined on one side by a free end 171 of coil body 152 and on another side by a free end 173 of coil body 152. A continuous section 175 of coil body 152 extends between end 171 and end 173. Gap 174 is formed such that there is a very small distance between the free ends 171, 173 of coil body 152. Forming gap 174 through body 152 results in some losses in coil performance. However, the single, narrow gap 174 formed through body 152 according to the embodiments of the present disclosure is far more desirable (i.e., causes much less loss) than the configuration of core 40 of FIG. 4 which includes two gaps.

Referring now to FIGS. 6(A)-(D), a second embodiment of a core according to the principles of the present disclosure is shown. Core 250 (FIG. 6(B)) includes a body 252 made by winding material, for example, of the type and in the manner described above with reference to FIG. 3. Body 252 includes an outer surface 254, an inner surface 256, a first side surface 258 and a second side surface 260 (not shown). Body 252 is encased within a partially rubber based package 262 (FIG. 6(A)). Package 262 includes flexible portion 253 (which in one embodiment is rubber based) and an epoxy or plastic portion 255 which adds to the strength of core 250. Flexible portion 253 acts as a hinge as is described below. Package 262 further includes an outer surface 264, an inner surface 266, a first side surface 268 and a second side surface 270 (not shown). Inner surface 266 of package 262 defines a central opening 272 for receiving a wire or wires such as in the twisted pair application described above.

Figure 6A:
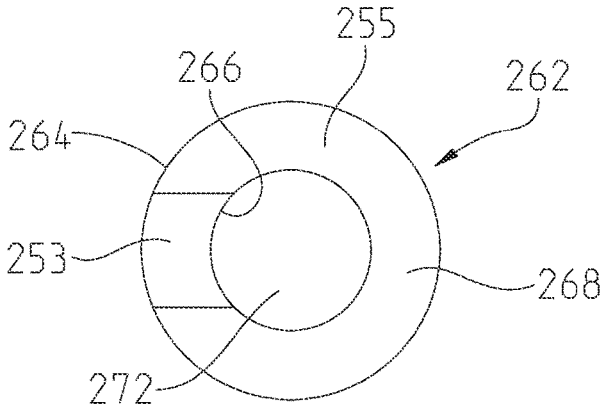
FIG. 6(A) is a top view of a package according to one embodiment of the present disclosure.
Figure 6B:
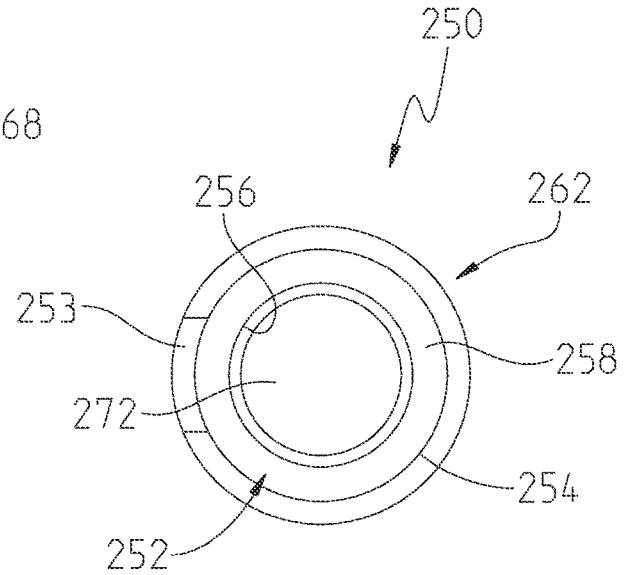
FIG. 6(B) is a top view of a core according to one embodiment of the present disclosure prior to formation of a gap in the core.
Figure 6C:
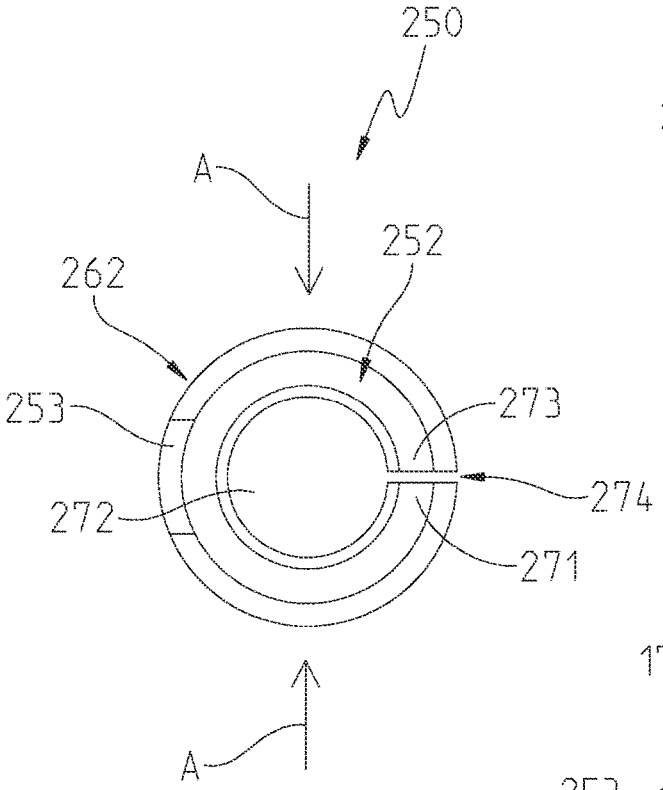
FIG. 6(C) is a top view of the core of FIG. 6(B) with a gap.

As shown in FIG. 6(C), after body 252 is installed in package 262, a narrow slit or gap 274 is formed through package 262 and body 252 between outer surface 264 of package 262 and inner surface 266. After gap 274 is formed, the free ends of core 250 are sealed using epoxy or other suitable material to protect them from the application environment. Because body 252 and flexible portion 253 of package 262 are flexible, exerting pressure in the direction of arrows A will cause gap 274 to close. Releasing such force permits core 250 to return to its uncompressed state such that gap 274 is again opened.

Figure 6D:
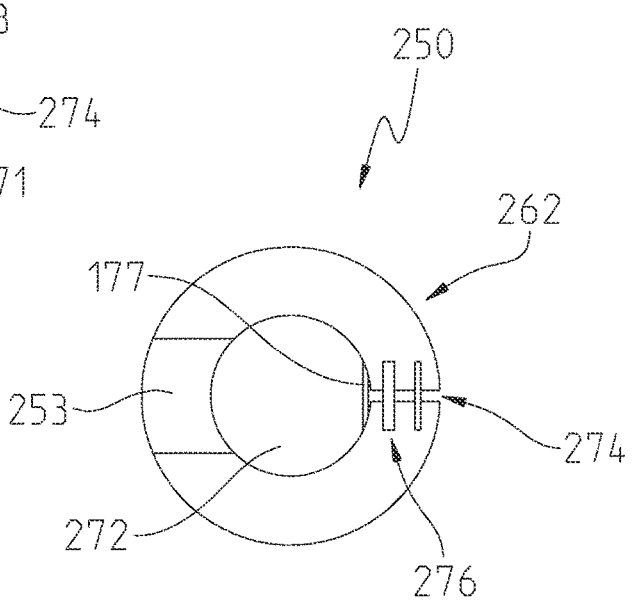
FIG. 6(D) is a top view of the core of FIG. 6(C) with a clamp.

As shown in FIG. 6(D), gap 274 may be retained in a closed position by using a clamp 276 or other suitable device. It is desirable to maintain gap 276 in the closed position during operation of core 250 to obtain the desired performance characteristics of core 250. As the configuration of core 250 permits gap 274 to be opened and closed, when core 250 fails in a twisted pair application such as that described above with reference to FIG. 3, clamp 276 may simply be removed to permit gap 274 to move to the opened position, and core 250 may be removed from the wire or wires that extend through central opening 272. The wire or wires may then be passed through a gap 274 of a new core 250 into central opening 272, and gap 274 of the new core 250 may be closed using clamp 276. In this manner, none of the other components of the application need to be disturbed in the process of replacing core 250.

As is the case with the embodiment of FIGS. 5(A)-(D), gap 274 is formed such that there is a very small distance between the free ends 271, 273 of coil body 252. Forming gap 274 through body 252 results in some losses in coil performance. However, the single, narrow gap 274 formed through body 252 according to the embodiments of the present disclosure is far more desirable (i.e., causes much less loss) than the configuration of core 40 of FIG. 4 which includes two gaps.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A magnetic core, comprising:

a core body formed from a winding of material;

a package that receives the core body, the package including at least a partially flexible portion, an outer surface, and an inner surface defining a central opening of the core;

a gap formed though the core body and the package between the outer surface of the package and the inner surface of the package;

wherein the core is configured to be flexibly movable between a compressed state wherein the gap is decreased to a closed position and an uncompressed state wherein the gap is increased to an opened position; and a clamp configured to move between a first position in which the clamp secures the core in the compressed state and a second position in which the clamp permits the core to move to the uncompressed state to permit passage of a wire into the central opening.

2. The core of claim 1, wherein the core body is formed in the shape of a toroid.

3. The core of claim 1, wherein the material is a flexible magnetic material.

4. The core of claim 1, wherein the package is formed of at least one of rubber or plastic.

5. The core of claim 1, further comprising a sealing material disposed in the gap to protect the core body from environmental conditions.

6. The core of claim 1, wherein the core body has a first end defining one side of the gap, a second end defining another side of the gap, and a continuous section extending between the first end and the second end.

7. The core of claim 1, further comprising a movable member coupled to the package to permit passage of a wire through the gap and into the central opening and to inhibit passage of the wire out of the central opening.

8. The core of claim 7, wherein the movable member is a biased hinge having one end attached to the inner surface of the package on one side of the gap and a flexible body extending across the gap.

9. A core, comprising:

a body formed from a winding of tape shaped material;

a package encasing the body, the package having an outer surface and an inner surface defining a central opening, the outer surface being radially outward of an outer surface of the body and the inner surface being radially inward of an inner surface of the body, the package including a flexible section configured to flex;

a single gap formed in the body and the package that extends between the outer surface of the package and the inner surface of the package through the body; and a clamp connected to the package, the clamp having a first end connected to the package on a first side of the gap and a second end connected to the package on a second side of the gap, the clamp being movable to a closed position thereby flexing the flexible section of the package such that the first side of the gap is moved toward the second side of the gap to reduce the gap;

wherein the clamp is configured to move to an opened position thereby permitting the flexible section of the package to return to an unflexed state such that the gap is increased to permit passage of a wire into the central opening.

10. The core of claim 9, wherein the body is formed of magnetic material wound into the shape of a toroid.

11. The core of claim 10, wherein the magnetic material is a flexible magnetic material.

12. The core of claim 9, wherein the package is formed of at least one of rubber or plastic.

13. The core of claim 9, further comprising a sealing material disposed in the gap to protect the body from environmental conditions.

14. The core of claim 9, wherein the body has a first end defining one side of the gap, a second end defining another side of the gap, and a continuous section extending between the first end and the second end.

15. The core of claim 9, further comprising a movable member coupled to the package to permit passage of a wire through the gap and into the central opening and to inhibit passage of the wire out of the central opening.

16. A method of forming a magnetic core, comprising:

winding material into a core body;

enclosing the body in a package having a partially flexible portion, an outer surface, and an inner surface defining a central opening of the core;

forming a gap through the body and the package between the outer surface of the package and the inner surface of the package;

installing a sealing material in the gap to protect the body from environmental conditions; and attaching a clamp to the package, the clamp being configured to move between a first position in which the clamp secures the core in a closed position wherein the gap is decreased and a second position in which the clamp permits the core to move to an opened position wherein the gap is increased to permit passage of a wire into the central opening.

17. The method of claim 16, further comprising coupling a movable member to the package to permit passage of a wire through the gap and into the central opening and to inhibit passage of the wire out of the central opening.

18. The method of claim 17, wherein the movable member is a biased hinge having one end attached to the inner surface of the package on one side of the gap and a flexible body extending across the gap.

* * * * *